US007176805B2

(12) United States Patent
Chapman, Jr. et al.

(10) Patent No.: US 7,176,805 B2
(45) Date of Patent: Feb. 13, 2007

(54) SYSTEM FOR CONTROLLING IGNITION SOURCES WHEN FLAMMABLE GAS IS SENSED

(75) Inventors: John Gilman Chapman, Jr., Delaware, OH (US); Nicholas Ashworth, Dublin, OH (US); Robert Burt, Columbus, OH (US); Timothy E. Wallaert, New Hudson, MI (US)

(73) Assignee: Maple Chase Company, Carol Stream, IL (US)

( * ) Notice: Subject to any disclaimer, the term of this patent is extended or adjusted under 35 U.S.C. 154(b) by 0 days.

(21) Appl. No.: 11/031,392

(22) Filed: Jan. 6, 2005

(65) Prior Publication Data

US 2006/0066452 A1 Mar. 30, 2006

Related U.S. Application Data

(60) Provisional application No. 60/535,286, filed on Jan. 8, 2004.

(51) Int. Cl.
*G08B 17/10* (2006.01)

(52) U.S. Cl. ..... 340/632; 340/622; 340/581; 340/693.6; 340/628; 340/506; 431/16; 431/22; 237/2 A; 237/12.3 C

(58) Field of Classification Search ..... 340/632, 340/622, 581, 693.6, 628, 506; 431/16, 22; 237/2 A, 12.3 C
See application file for complete search history.

(56) References Cited

U.S. PATENT DOCUMENTS

| | | | | |
|---|---|---|---|---|
| 5,793,296 | A | 8/1998 | Lewkowicz | |
| 5,797,358 | A | 8/1998 | Brandt et al. | |
| 6,484,951 | B1 * | 11/2002 | Mueller | 237/2 A |
| 6,776,708 | B1 | 8/2004 | Daoutis et al. | |
| 2004/0124989 | A1 * | 7/2004 | Bachinski et al. | 340/632 |

* cited by examiner

*Primary Examiner*—Tai Nguyen
(74) *Attorney, Agent, or Firm*—Reinhart Boerner Van Deuren P.C.

(57) ABSTRACT

Upon detection of a flammable gas condition, an intelligent thermostat regulates operation of appliances that have sources of ignition which could be the source of or may ignite the flammable gas. This hazardous condition is detected by a flammable gas detector and is communicated to the intelligent thermostat by wired or wireless communications. The intelligent thermostat then communicates with these appliances either via wired or wireless communications. The intelligent thermostat may also provide a visual warning user interface screen to inform the occupant of the hazardous condition, and may signal smoke detectors in the dwelling to sound an audible flammable gas warning. Alternatively, the flammable gas detector may signal the smoke detectors in the dwelling to sound an audible flammable gas warning directly.

8 Claims, 2 Drawing Sheets

SYSTEM FOR CONTROLLING IGNITION SOURCES WHEN FLAMMABLE GAS IS SENSED

CROSS-REFERENCE TO RELATED PATENT APPLICATIONS

This patent application claims the benefit of U.S. Provisional Patent Application No. 60/535,286, filed Jan. 8, 2004, the teachings and disclosure of which are hereby incorporated in their entireties by reference thereto.

FIELD OF THE INVENTION

The present invention relates generally to flammable gas detection systems, and more particularly to an appliance control system that limits operation of ignition sources and that provides a warning when flammable gas has been detected.

BACKGROUND OF THE INVENTION

As consumer electronics continue to decrease in cost and increase in reliability and features provided, their use in many consumer products becomes more practical, and even desirable. One factor contributing to the acceptability of electronic controls in many consumer products, including consumer home appliances, is that the population as a whole is becoming more computer literate and used to electronic displays and push button controls. No longer are consumers turned off by electronic displays and control systems in favor of their electromechanical counterparts. Indeed, consumers have come to demand increased sophistication in the cycles provided by their appliances.

To meet this demand, many manufacturers are now providing multi-functional electronic controls in their consumer appliances. As an added benefit of these electronic controls, manufacturers are able to incorporate intelligence and communications capability into the controls. As such, these electronic controls add greater flexibility to the operation of the appliances and allow for integration of new functions which, before such integration, were not feasible. In addition to enhanced operability, these electronic controllers also provide diagnostic system checking to ensure that the appliance is operating properly.

Unfortunately, certain malfunctions of appliances that include ignition/combustion sources, such as stoves, furnaces, hot water heaters, etc., can release flammable gas into the dwelling or building. This release of flammable gas could create a hazardous condition which could endanger the property and life of the occupants. Fortunately, the inclusion of the electronic controls has allowed many such appliances to detect such a failure condition and disable the appliance's ignition/combustion source. This greatly reduces the possibility of an uncontained ignition of the flammable gas caused by the appliance itself.

While the disabling of the ignition/combustion source of the malfunctioning appliance by its electronic controller is a great advance, the flammable gas may still be ignited by other appliances that have ignition sources and that are operating properly. Additionally, the occupant of the dwelling or building may inadvertently ignite the flammable gas. This inadvertent ignition may occur as a result of turning on a light when the occupant comes to inspect the appliance to find out why it is not working. For example, if a water heater detects flammable gas, its controller will disable its ignition source. The occupant will become aware that the water heater is not working when there is no hot water available. In order to determine the problem, the occupant will likely go to the water heater. As most such appliances are installed in basements or utility rooms, the occupant will likely have to turn on a light near the water heater. Unfortunately, such action could ignite the flammable gas, damage the property, and injure the occupant.

There exists, therefore, a need in the art for coordinated operation between the detection of flammable gas and the operation of appliances that include ignition sources that may be causing or that could exacerbate the hazardous condition. This need extends to the coordination of lighting sources and electrical circuits that might cause a spark when turned on or switched and that may ignite the flammable gas. Further, there exists a need in the art for a notification system that can remotely warn the occupant of the dwelling of the hazardous condition so that inadvertent ignition of flammable gas may be avoided.

BRIEF SUMMARY OF THE INVENTION

In view of the above, it is an object of the present invention to provide a new and improved appliance control network that regulates appliances having ignition sources once flammable gas has been detected within a dwelling. More particularly, the present invention is directed to an appliance control system that utilizes an intelligent thermostat that receives warning information from a flammable gas detector indicating that flammable gas has been sensed within the dwelling. The flammable gas detector may be integral with an appliance or may be an external detector. The intelligent thermostat then operates to control appliances within the dwelling that contain ignition sources to reduce or eliminate the possibility of ignition of the flammable gas by such appliances. This intelligent thermostat also provides a warning of the flammable gas condition. The thermostat may also signal installed smoke or other threat detectors within the dwelling to sound a flammable gas alarm. Since ignition of the flammable gas may also occur as a result of turning on a light or switching an electrical circuit, the system of the invention may also disable lighting and/or other circuits where flammable gas is detected.

In an embodiment of the present invention, an advanced thermostat includes a user interface and wireless or wired network communications capability to enable control and diagnostic communications between the thermostat and the various consumer appliances, lighting control systems, and electrical circuit breakers in the home or building, and between the thermostat and an external flammable gas detector if provided. The thermostat in one embodiment also provides communications to installed smoke or hazardous condition detectors to sound an alarm to alert the occupant of the presence of flammable gas. The thermostat user interface allows the homeowner to view warning information describing the hazardous condition and the current operating mode of the thermostat. The thermostat also sends control signals to the appliances that contain ignition sources to disable their operations so that the possibility that the flammable gas will be ignited by one of these appliances will be greatly lessened. A signal is also provided, either by the thermostat or by the detector directly, to a lighting or electrical circuit controller to disable the lighting or circuits where flammable gas has been detected.

Such control signals may be transmitted to the appropriate appliances and lighting controller via wireless communication, or wired communication. The wired communication may utilize individual connections between the thermostat and the individual appliances, detectors, and lighting controller, or may utilize a system BUS to which each of the appliances, detectors, and the thermostat attach. The communication of the warning signal information from the flammable gas detector may similarly utilize wireless or wired communication. In this way, the system of the present invention disables the operation of appliances that may be the cause of or that could ignite the flammable gas, including lighting and electrical systems.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
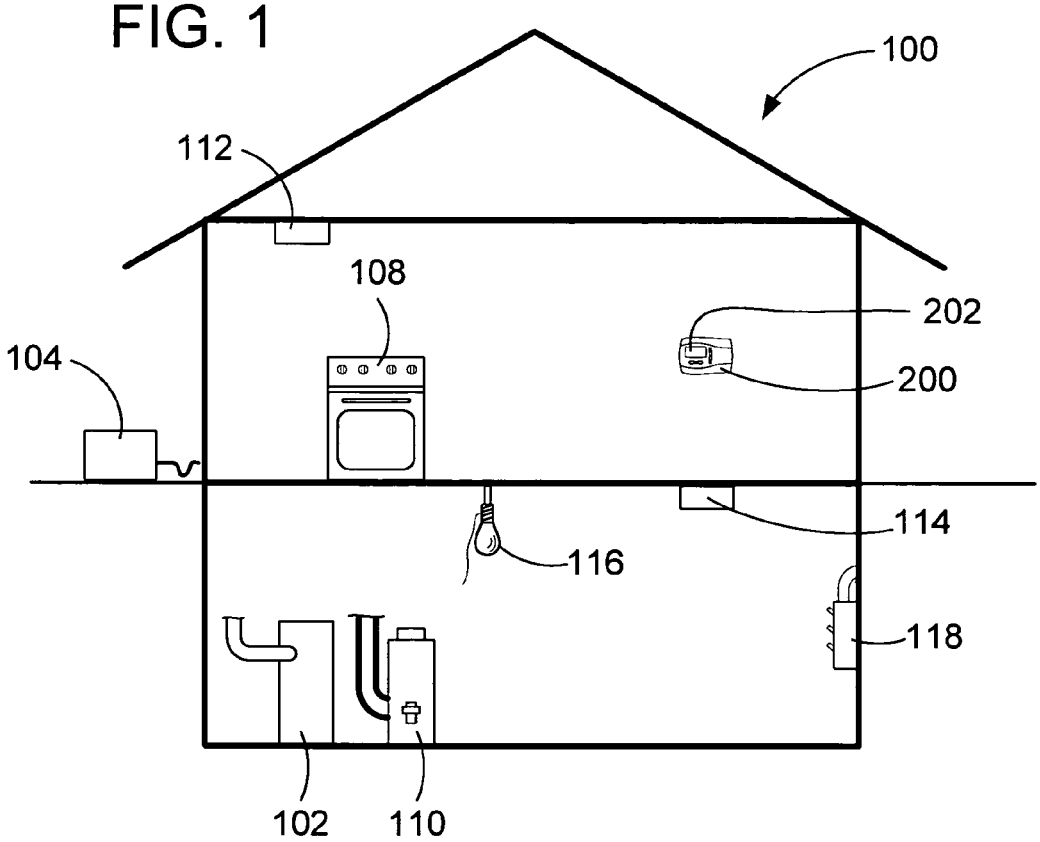
FIG. 1 is a simplified illustration of a home environment containing a plurality of consumer appliances in which the system of the instant invention is installed.

FIG. 1 illustrates a simplified home environment 100 into which the system of the present invention finds particular applicability. However, one skilled in the art will recognize that the system of the present invention is not limited to a home environment, but may also be installed in a commercial environment, etc. This typical environment 100 includes an intelligent thermostat 200. As is typical, the thermostat 200 controls heating of the home environment 100 by the furnace 102, and possibly cooling of the home environment 100 by the air conditioning system 104. The interface to both the furnace 102 and the air conditioning system 104 is typically pre-wired in the home environment 100, although the communications control from the thermostat 200 may also be wireless as desired by providing receiver/transmitter circuitry in the furnace 102 and/or the air conditioning system 104. Similar receiver/transmitter circuitry is also required in thermostat 200 to provide this communications capability.

The typical home environment 100 also includes a plurality of consumer appliances, such as a stove 108, hot water heater 110, etc. As discussed above, many such appliances now include electronic controllers that regulate operation of the appliance. With the provision of such electronic controllers, communication circuitry may also now be included in these appliances to allow coordinated operation, enhanced diagnostic features, and remote controllability. Preferably, such communication circuitry includes wireless receiver/transmitter circuitry. However, the system of the present invention also allows for wired communication with the appliances via discreet wires, or via a communications BUS to which the appliance is attached as will be discussed more fully below. Through the provision of such communications, the system of the present invention is particularly enabled.

Specifically, the system of the present invention includes an intelligent thermostat 200 that is capable of receiving flammable gas warning information from flammable gas detectors, for example detectors 112, 114 located throughout the home or commercial environment 100, or from detectors that are provided integrally with any appliance, e.g. integral with water heater 110. When any of the flammable gas detectors signal that flammable gas has been detected, the intelligent thermostat 200 operates to regulate the operation of the appliances that contain an ignition source. In this way, the intelligent thermostat 200 attempts to reduce or eliminate the ignition of flammable gas within the environment 100.

In a typical home environment 100, these appliances include a furnace 102, the stove 108, and the water heater 110, although other appliances that include ignition sources or that might otherwise malfunction to produce flammable gas may also be included. Because the flammable gas may be ignited by a spark caused by turning on a light 1116, the system of the present invention also preferably operates to disable the lighting and/or electrical circuits 118 where the flammable gas has been detected. Because of this intervention control that disrupts the normal operation of these appliances, the thermostat also provides a visual warning describing the hazardous condition, and may also initiate audible alarms to warn the occupants. Each of these functions will be described more fully below.

In order to provide the high flammable gas level information to the thermostat 200 of the present invention, the information must be communicated from the flammable gas detectors, either internal to the appliance or externally mounted, to the thermostat 200. These external flammable gas detectors may be included in the smoke or other threat detectors 112, 114, or may be separate. This transmission of information may be facilitated by a wired network connecting the individual detectors to the thermostat. Other wired network structures may also be utilized, including the provision of a system BUS to which each of the appliances and detectors, or a combination thereof, and the thermostat 200 connect. As is well known in the art, information communicated on the system BUS includes address information identifying the source and/or destination of the information transmitted thereon. Such individual addressing is not typically required in the wired network whereby each individual appliance and/or detector is separately wired to the thermostat 200. Various other wired infrastructures could be utilized with the system of the present invention, and are considered within the scope thereof.

With the increasing use, sophistication, reliability, data rates, and security of wireless communication protocols, a preferred embodiment of the present invention utilizes wireless communication between the appliances, detectors, and thermostat to communicate system information and control signals therebetween. However, it is recognized that not all of the consumer appliances or detectors may include such wireless communications capability. Therefore, a preferred embodiment to the thermostat 200 of the present invention includes the capability to communicate both wirelessly and through a wired connection. For the wireless communication, various wireless communication protocols and standards may be implemented depending upon the particular home environment 100 in which the system is to be installed. That is, while the Bluetooth wireless standard may be utilized in a very small environment, its range limitations may make it unsuitable for larger or typical home environments 100. However, there are numerous other wireless protocols that can be utilized to provide the wireless connectivity between the thermostat 200 and the appliances and detectors. These other wireless protocols include, but are not limited to, the 802.11 or 802.15 family of standards. While proprietary wireless protocols may also be utilized, the use of a standard wireless protocol ensures interoperability with appliances and detectors by different manufacturers.

Figure 2:
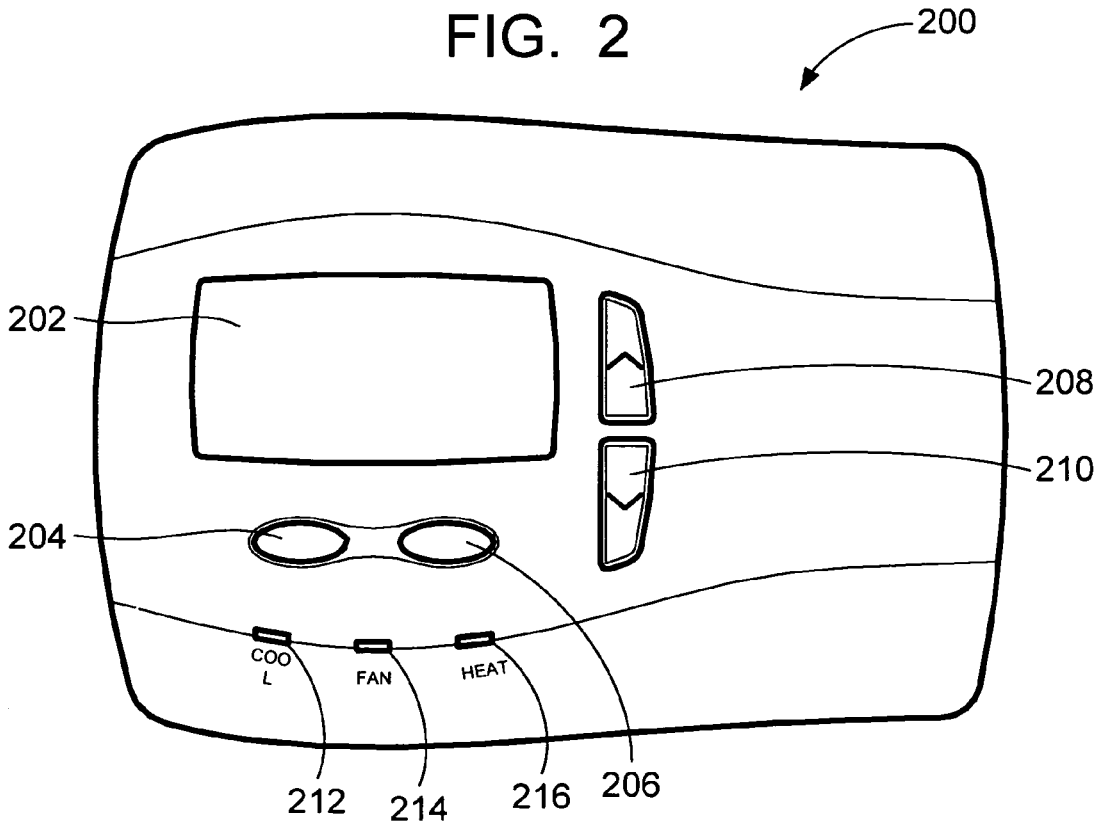
FIG. 2 is a front view illustration of one embodiment of an advanced thermostat constructed in accordance with the teachings of the present invention.

An embodiment of a thermostat constructed in accordance with the teachings of the present invention to incorporate the coordinated appliance control and occupant warning upon detection of flammable gas is illustrated in FIG. 2. As may be seen from this FIG. 2, this embodiment of the thermostat 200 includes a user display 202 on which is typically displayed programmatic, system, and ambient information regarding the operation of the HVAC system with which it is typically associated. This user display 202 may take various forms as are well known in the art, and in a preferred embodiment is a dot matrix LCD display. As will be discussed more fully below, this user display 202 may also be used in accordance with the present invention to provide the remote warning of the flammable gas condition to the occupant.

With such a display 202, the consumer may activate various programmatic and control functions via a pair of soft keys 204, 206. The functionality executed by these soft keys 204, 206 varies dependent upon the programmatic state in which the thermostat 200 is at the time one of the soft keys 204, 206 is depressed. The particular functionality that will be instituted upon selection of one of the soft keys 204, 206 is displayed in an area of the user display 202 proximate the key 204, 206 which will institute that function. That is, the function that will be instituted upon selection of soft key 204 will be located generally in the lower left hand portion of user display 202 while the functionality that will be instituted by selection of soft key 206 will be located generally in the lower right hand portion of user display 202. These functional indicators may change depending on the program state and mode in which the thermostat is currently operating.

In addition to the soft keys 204, 206, this embodiment of the thermostat 200 of the present invention also includes adjustment keys 208, 210. These adjustment keys 208, 210 may serve to adjust a currently selected parameter up or down, such as in the case of setting the control temperature at which the thermostat will maintain the ambient environment. Additionally, these keys 208, 210 may scroll through the available data for a selected parameter, such as scrolling through alphanumeric data that may be selected for a given parameter. These keys 208, 210 may also function as soft keys depending on the programmatic state in which the thermostat is operating. When this functionality is provided, the function that will be instituted by selection of key 208 will be provided generally in the upper right hand corner of display 202, while the functionality that will be instituted by selection of key 210 will be displayed generally in the lower right hand corner of user display 202. In addition to the above, other user input means, such as an alphanumeric keypad, user rotatable knob, a touch screen, etc. may be utilized instead of the buttons 204–210 illustrated in the embodiment of FIG. 2.

In this embodiment, the thermostat 200 also includes operating mode visual indicators 212, 214, 216. These indicators 212–216 provide a visual indication of the current operating mode of the thermostat. In the embodiment illustrated in FIG. 2, indicator 212 will illuminate while the thermostat 200 is operating in the cooling mode. Indicator 216 will illuminate while the thermostat 200 is operating in the heating mode. Finally, indicator 214 will illuminate to indicate that the fan is operating. Depending on the particular application, this indicator 214 may illuminate whenever the fan is running, or may illuminate only when the fan is selected to run continuously.

In embodiments of the present invention that do not utilize automated switching control between the heating and cooling modes of operation, these indicators 212–216 may operate as user selectable switches to allow the consumer to select the operating mode of the thermostat 200. For example, during the summer months the consumer may select the cooling mode by depressing indicator 212. In this mode, the furnace will not be turned on even if the interior ambient temperature drops below the set point. To switch from the cooling to the heating mode of operation, the consumer, in this alternate embodiment, would need to select indicator 216 to allow the thermostat 200 to operate the furnace. Consumer selection in this embodiment of indicator 214 would operate the fan continuously, as opposed to its normal automatic operation based upon a call for cooling or heat by the thermostat 200. In a still further embodiment of the present invention, as will be discussed more fully below, the indicators 212–216 may also be utilized to provide a visual indication of system trouble or trouble with one of the appliances with which the thermostat 200 is in communication.

Having discussed the physical structure of one embodiment of a thermostat 200 constructed in accordance with the teachings of the present invention, the discussion will now focus on the operation of the system during detection of a flammable gas condition which forms an aspect of the present invention. Indeed, while the following discussion will utilize the structure of the thermostat 200 illustrated in FIG. 2, those skilled in the art will recognize that various other structures can be utilized without departing from the spirit and scope of the present invention. That is, regardless of the user input mechanisms utilized by the particular embodiment of the thermostat 200 of the present invention, the communications and programmatic steps provided in the following discussion may be used.

As introduced above, the existence of flammable gas within a dwelling or commercial building presents a significant danger. This danger results from the fact that normal operation of other appliances, electrical circuits, lighting systems, etc., may inadvertently ignite the flammable gas resulting in fire and possibly damage of the structure itself. If occupants are in the vicinity of the ignition of the flammable gas, there is a likelihood that injuries will result. As such, the system of the present invention, through its communications network, coordinates operation of elements that may inadvertently ignite the flammable gas. This system also provides warning indications to the occupants of the building so as to alert them to the potentially dangerous situation. Preferably, such warnings may be delivered to the occupants while they are still remote from the location of the flammable gas.

Returning for a moment to FIG. 1, upon detection of flammable gas by a hazardous condition detector 114 or 112, or by an included flammable gas detector that is integral to the appliances, for example integral with water heater 110, the detector transmits this information to the intelligent thermostat 200 of the present invention. Alternatively, or additionally, this transmission of information may also be received by other system controllers, such as a lighting and/or electrical controller 118, and may also be received by other threat detectors. As will be recognized by those skilled in the art, the inclusion of a separate lighting and/or electrical control system is most typically found in commercial buildings. However, the controller 118 may also be viewed as a smart circuit breaker box that may include independent control, or preferably, allows for remote coordinated control by the intelligent thermostat 200 of the present invention to disable certain circuits.

Once the intelligent thermostat 200 has received this flammable gas warning signal, either via the wireless or wired communication network, the thermostat 200 operates to disable the sources of ignition of the appliances within the dwelling. As illustrated in FIG. 1, such appliances include the furnace 102, the stove 108, and the water heater 110. By so doing, the thermostat 200 ensures that inadvertent ignition of the flammable gas within the dwelling will not be a result of operation of one of these appliances.

As discussed above, another common source of ignition for the flammable gas within a dwelling is a spark generated by the turning on of a light when the occupant goes to determine why, for example, there is no hot water in the dwelling. Recognizing this, the intelligent thermostat 200 of the present invention also transmits a signal to disable the lighting system where the flammable gas has been detected. The thermostat 200 may also disable the electrical circuits where the flammable gas has been detected. Indeed, in the typical dwelling installation, the disablement of both the lighting and electrical systems may be accomplished through the disablement of the latter via electrical breaker box 118. That is, breaker box 118 may be commanded to isolate the circuit branch supplying electricity to the location where flammable gas has been detected. In commercial buildings, the isolation of the lighting and electrical systems where the flammable gas has been detected may be accomplished via a separate control system.

Figure 3:
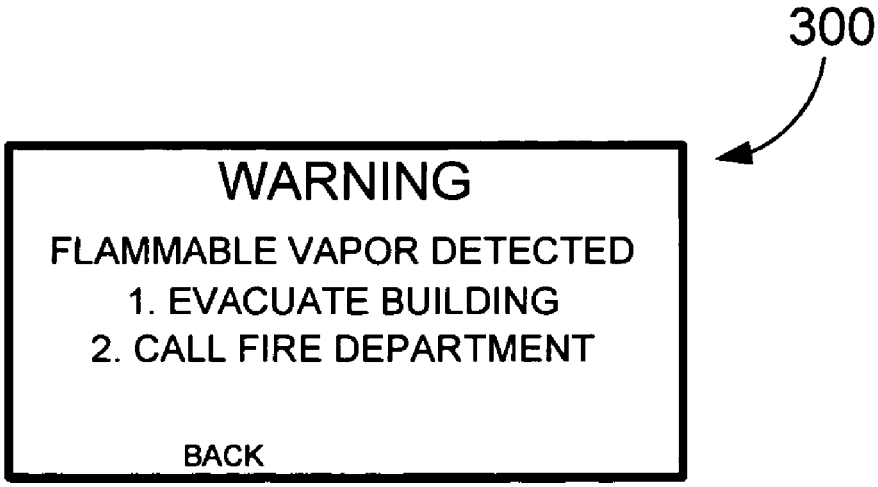
FIG. 3 is a graphical illustration of an exemplary hazardous condition user interface screen produced by an embodiment of the present invention.

Once the appropriate appliances, lighting, and/or circuits have been isolated and/or disabled, the intelligent thermostat 200 of the present invention provides a visual alert on user interface screen 202. This visual warning may take the form of the warning screen 300 illustrated in FIG. 3. In this exemplary warning screen, the occupants are alerted to the warning condition detected, and are provided with instructions to evacuate the building and then to call the fire department. To draw additional attention to this warning message, the intelligent thermostat of the present invention may also provide other visual cues, such as turning on the back light, flashing the display, turning on or flashing the indicators 212–216, etc. Additionally, in view of the hazardous nature of flammable gas within a dwelling, the thermostat 200 may also transmit a signal to the hazardous condition detectors 112, 114 within the dwelling to sound a flammable vapor alert signal. Preferably, this flammable vapor alert signal is different than the typical smoke detector warning signal so as to provide a distinctive audible warning of the flammable vapor condition.

While a preferred embodiment of the present invention utilizes the intelligent thermostat 200 to coordinate the operation of the various subsystems, appliances, etc., the system of the present invention also contemplates autonomous control by each of these subsystems, appliances, etc., upon receipt of a flammable vapor detected signal transmitted from a flammable vapor detector. That is, if the hazardous condition detector 114 were to detect flammable vapor, it would transmit a warning signal via the communications network (wired and/or wireless). Each of the individual components connected to the communications network would autonomously enter a safe mode of operation so as to not inadvertently ignite the flammable gas. For example, the water heater 110 upon receipt of the flammable gas detection signal would operate to disable its sources of ignition. Similarly, the lighting control and/or electrical systems would also operate to autonomously disable their system elements at least in the locations where flammable gas has been detected. Likewise, other detectors in the building, e.g. detector 112, could also receive this flammable gas detected signal and sound its audible alert to notify the occupants of the hazardous condition.

Further, in embodiments of the present invention that utilize a central control point to coordinate operation of the system, this central control point need not be a thermostat. That is, the central control point could be a separate controller having a user interface whose functionality is limited to coordination of and communication with the components in the system. This separate controller may be a stand alone controller, may be a PC application, etc. Additionally, in embodiments of the present invention in which an intelligent thermostat provides this central control point, the user interface and the control portions of such a thermostat need not be integrated into a single housing. That is, the user interface may be mounted in a commonly user accessed area for convenience, while the control electronics could be located remotely from the user interface.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of reducing a likelihood of igniting flammable gas, comprising the steps of:

receiving a flammable gas warning signal transmitted by an external flammable gas detector; and disabling a source of ignition; and wherein the step of receiving the flammable gas warning signal comprises the step of receiving by a thermostat the flammable gas warning signal, and wherein the step of disabling the source of ignition comprises the step of transmitting by the thermostat an appliance control signal to an electronic controller of an appliance having the source of ignition commanding the electronic controller of the appliance to disable the source of ignition of the appliance.

2. The method of claim 1, further comprising the step of displaying on a user interface display of the thermostat flammable gas warning information.

3. The method of claim 1, further comprising the step of transmitting by the thermostat an electrical circuit control signal to a smart circuit breaker box commanding the smart circuit breaker box de-energizing at least an electrical circuit supplying electric power to an area corresponding to the location of the external flammable gas detector.

4. The method of claim 1, further comprising the step of transmitting by the thermostat a flammable gas detected signal to at least one hazardous condition detector commanding the hazardous condition detector to sound a flammable gas alarm.

5. The method of claim 1, wherein the step of disabling the source of ignition further comprises the step of disabling by the thermostat a furnace controlled thereby.

6. An appliance control network, comprising:

an appliance having a source of ignition and an electronic controller configured to control the source of ignition;

a flammable gas detector; and a thermostat operably coupled to the electronic controller of the appliance; and wherein the flammable gas detector transmits a warning signal upon detection of a flammable gas; and wherein the thermostat receives the warning signal from the flammable gas detector and transmits an appliance control signal to the electronic controller to disable the appliance's source of ignition.

7. The network of claim 6, wherein the thermostat includes a user interface display, and wherein the thermostat displays flammable gas detected warning information on the user interface display upon receipt of the warning signal.

8. The network of claim 6, further comprising a smart circuit breaker box, and wherein the thermostat transmits an electric circuit control signal to the smart circuit breaker box to de-energize at least an electrical circuit supplying electric power to an area corresponding to the location of the flammable gas detector.

* * * * *